US007174994B1

(12) United States Patent
Coffield et al.

(10) Patent No.: US 7,174,994 B1
(45) Date of Patent: Feb. 13, 2007

(54) UTILITY LADDER

(76) Inventors: Tamara L. Coffield, 2142 Aster Pl., Costa Mesa, CA (US) 92627; Tyler L. Watson, 3020 White Pine Dr., Monrovia, MD (US) 21770; Tyler W. Watson, 3020 White Pine Dr., Monrovia, MD (US) 21770

( * ) Notice: Subject to any disclaimer, the term of this patent is extended or adjusted under 35 U.S.C. 154(b) by 300 days.

(21) Appl. No.: 10/782,120

(22) Filed: Feb. 19, 2004

(51) Int. Cl.
*E06C 7/00* (2006.01)

(52) U.S. Cl. ..... 182/129

(58) Field of Classification Search ..... 182/129
See application file for complete search history.

(56) References Cited

U.S. PATENT DOCUMENTS 3,325,639 A * 6/1967 King ..... 362/270
3,851,166 A * 11/1974 Kohler ..... 362/198
4,457,527 A * 7/1984 Lowery ..... 280/47.19
4,766,525 A 8/1988 Loughlin
5,219,446 A * 6/1993 Klepac ..... 362/154
5,419,409 A * 5/1995 Corulla ..... 182/129
5,518,053 A * 5/1996 Robison ..... 144/286.1
5,584,357 A * 12/1996 Gugel et al. ..... 182/129
5,584,457 A * 12/1996 Fawcett ..... 248/229.1
5,941,344 A * 8/1999 Spadaro ..... 182/129
5,954,154 A 9/1999 Ziolkowski
6,240,987 B1 * 6/2001 Birkeland ..... 144/286.1
6,502,664 B1 1/2003 Peaker, Sr.

FOREIGN PATENT DOCUMENTS

DE 3150915 A1 * 6/1983

* cited by examiner

*Primary Examiner*—Alvin Chin-Shue

(57) ABSTRACT

A utility ladder for illuminating a work area that a user is working on. The utility ladder includes a ladder assembly being designed for being positioned on a support surface. The ladder assembly is designed for supporting the user at a desired height above the support surface when the user is standing on the ladder assembly. A lighting assembly is coupled to the ladder assembly. The lighting assembly is designed for being selectively operationally coupled to a power source whereby the lighting assembly is for selectively emitting light to illuminate the work area the user is working on when the lighting assembly is operationally coupled to the power source.

1 Claim, 2 Drawing Sheets

UTILITY LADDER

BACKGROUND OF THE INVENTION

1. Field of the Invention

The present invention relates to ladder beacons and more particularly pertains to a new utility ladder for illuminating a work area that a user is working on.

2. Description of the Prior Art

The use of ladder beacons is known in the prior art. U.S. Pat. No. 4,766,525 describes a device for aiding in the locating of a ladder that has been extended by a firefighter. Another type of ladder beacon is U.S. Pat. No. 5,954,154 having a light source coupled to the top of a ladder and operationally coupled to the bottom step of the ladder to alert the user when the user has stepped on the bottom step of the ladder. U.S. Pat. No. 6,502,664 has a step ladder with a plurality of accessories to increase the functionality of the step ladder.

While these devices fulfill their respective, particular objectives and requirements, the need remains for a device that has certain improved features allowing the user to illuminate the work area that the user is working on.

SUMMARY OF THE INVENTION

The present invention meets the needs presented above by providing a lighting assembly that is coupled to the ladder assembly and emits light to illuminate the work area.

Still yet another object of the present invention is to provide a new utility ladder that allows for the direction of the lighting assembly to be changed to illuminate a desired portion of the work area.

Even still another object of the present invention is to provide a new utility ladder that provides an outlet member to allow power tools to be plugged in while the user is positioned on the ladder assembly.

To this end, the present invention generally comprises a ladder assembly being designed for being positioned on a support surface. The ladder assembly is designed for supporting the user at a desired height above the support surface when the user is standing on the ladder assembly. A lighting assembly is coupled to the ladder assembly. The lighting assembly is designed for being selectively operationally coupled to a power source whereby the lighting assembly is for selectively emitting light to illuminate the work area the user is working on when the lighting assembly is operationally coupled to the power source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
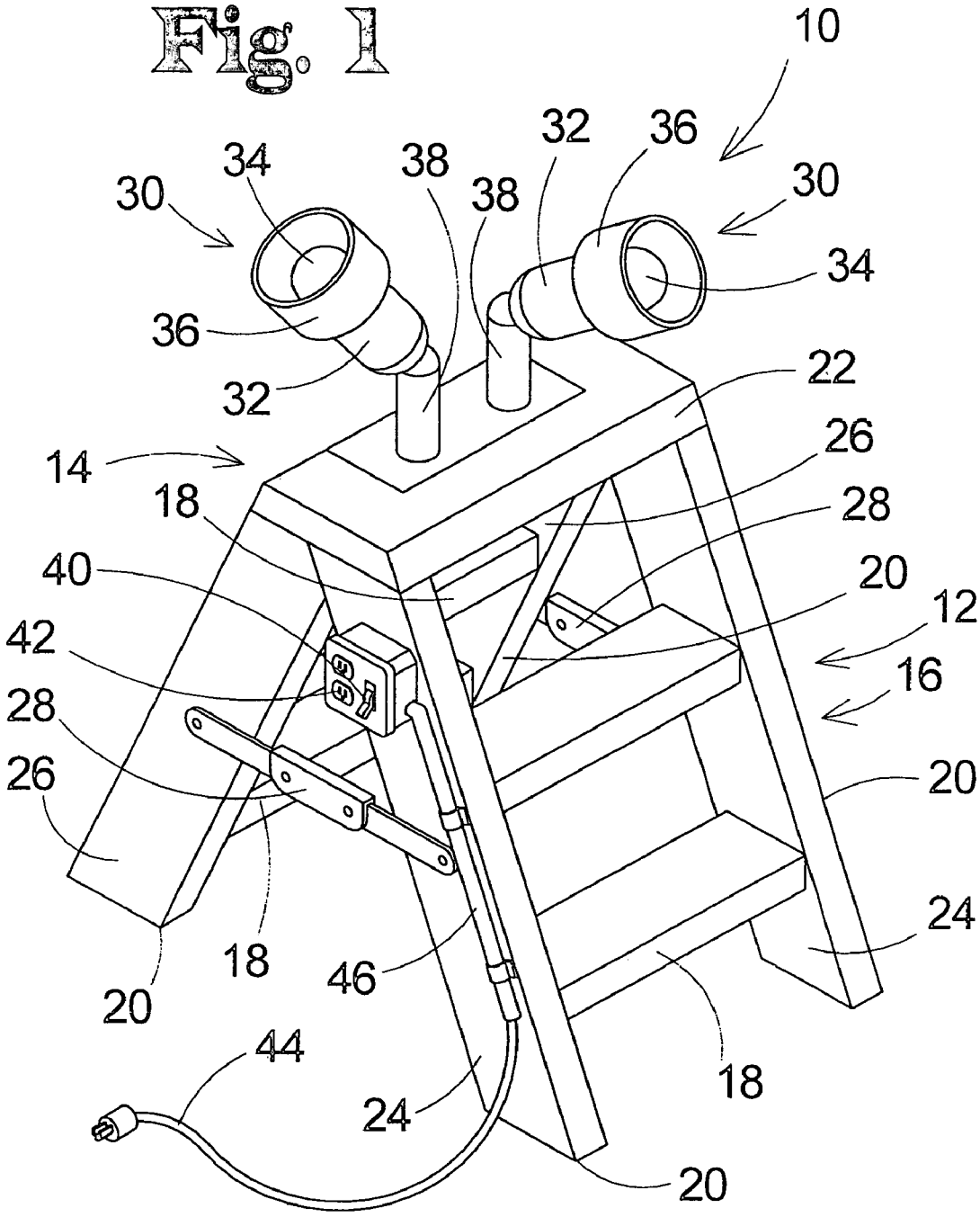
FIG. 1 is a perspective view of a new utility ladder according to the present invention.
Figure 2:
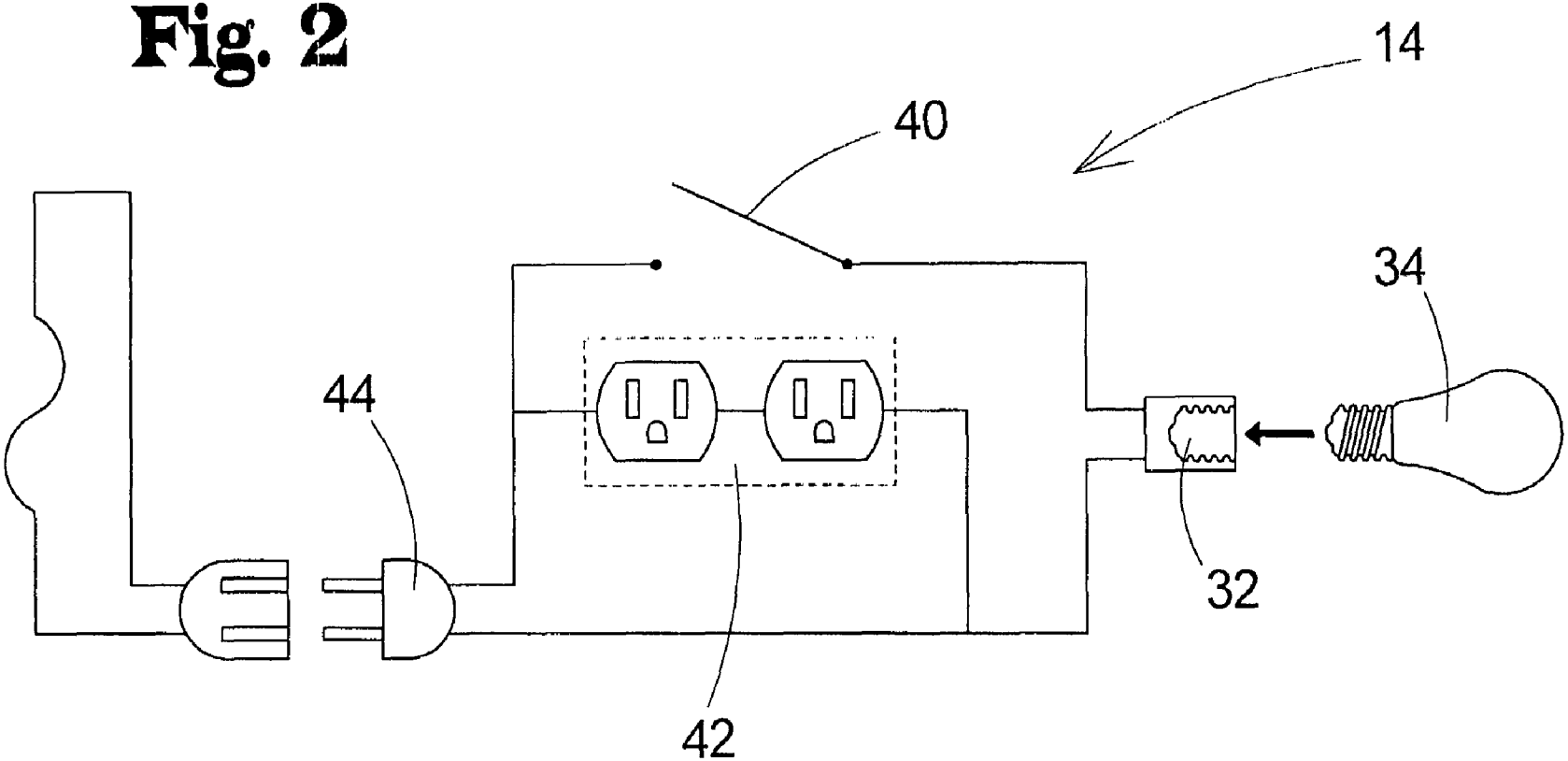
FIG. 2 is a schematic view of the lighting assembly and outlet member of the present invention.

With reference now to the drawings, and in particular to FIGS. 1 and 2 thereof, a new utility ladder embodying the principles and concepts of the present invention and generally designated by the reference numeral 10 will be described.

As best illustrated in FIGS. 1 and 2, the utility ladder 10 generally comprises a ladder assembly 12 being designed for being positioned on a support surface. The ladder assembly 12 is designed for supporting the user at a desired height above the support surface when the user is standing on the ladder assembly 12.

A lighting assembly 14 is coupled to the ladder assembly 12. The lighting assembly 14 is designed for being selectively operationally coupled to a power source whereby the lighting assembly 14 is for selectively emitting light to illuminate the work area the user is working on when the lighting assembly 14 is operationally coupled to the power source.

The ladder assembly 12 comprises a frame assembly 16 and a plurality of step members 18. Each of the step members 18 is coupled to the frame assembly 16. Each of the step members 18 is designed for supporting feet of the user when the user is stepping on the ladder assembly 12. The frame assembly 16 is designed for abutting the support surface whereby the frame assembly 16 is designed for supporting a weight of the user when the user is standing on the step members 18. The lighting assembly 14 is coupled to the frame assembly 16.

The frame assembly 16 of the ladder assembly 12 comprises a plurality of leg members 20 and a deck member 22. The of leg members 20 are coupled to the deck member 22 whereby the leg members 20 extend outwardly from the deck member 22 at an angle to provide the greatest amount of support when the user is standing on the ladder assembly 12. Each of the step members 18 is coupled between a pair of the leg members 20.

The leg members 20 of the ladder assembly 12 comprise a pair of front legs 24 and a pair of rear legs 26. The front legs 24 are fixedly coupled to the deck member 22. The rear legs 26 are pivotally coupled to the deck member 22 whereby the rear legs 26 are selectively pivoted towards the front legs 24 to facilitate storage of the ladder assembly 12. The rear legs 26 are pivoted away from the front legs 24 to be positioned at an angle the front legs 24 to support the user standing on the ladder assembly 12.

The ladder assembly 12 comprises at least one bracing member 28. The bracing member 28 extends between one of the front legs 24 and an associated one of the rear legs 26. The bracing member 28 is for selectively maintaining positioned of the rear legs 26 with respect to the front legs 24 to inhibit the rear legs 26 inadvertently moving with respect to the front legs 24 and collapsing the ladder assembly 12 when the user is standing on the ladder assembly 12.

The lighting assembly 14 comprises at least one light fixture assembly 30. The light fixture assembly 30 is coupled to the deck member 22 of the ladder assembly 12. The light fixture assembly 30 is designed for being operationally coupled to the power supply whereby the light fixture assembly 30 is designed for emitting light to illuminate the work area when the light fixture assembly 30 is coupled to the power source.

The light fixture assembly 30 comprises a socket member 32 and a light emitting member 34. The socket member 32 is coupled to deck member 22 of the ladder assembly 12. The socket member 32 is designed for being operationally coupled to the power source. The light emitting member 34 is operationally coupled to the socket member 32 whereby the socket member 32 supplies power to the light emitting member 34. The light emitting member 34 is designed for emitting light to illuminate the work area.

The light fixture assembly 30 comprises a shroud member 36. The shroud member 36 is coupled to the socket member 32 whereby the shroud member 36 extends around the light emitting member 34 when the light emitting member 34 is operationally coupled to the socket member 32. The shroud member 36 is for reflecting light emitted from the light emitting member 34 toward the work area.

The light fixture assembly 30 comprises a stanchion member 38. The stanchion member 38 is coupled to the deck member 22 of the ladder assembly 12 whereby the stanchion member 38 is positioned between the socket member 32 and the deck member 22 of the ladder assembly 12. The socket member 32 is pivotally coupled to the stanchion member 38 whereby the socket member 32 is selectively positionable with respect to the stanchion member 38 to allow the user to adjust the portion of the work area being illuminated by the light emitting member 34.

The lighting assembly 14 comprises a switch member 40. The switch member 40 is coupled to one of the leg members 20 of the ladder assembly 12 whereby the switch member 40 is designed for being actuated by the user. The switch member 40 is operationally coupled to the light fixture assembly 30 whereby the switch member 40 is operationally coupled between the light fixture assembly 30 and the power source. The switch member 40 is designed for controlling the flow of power to the light fixture assembly 30 from the power source when the switch member 40 is actuated by the user.

An outlet member 42 is coupled to the ladder assembly 12. The outlet member 42 is designed for being selectively operationally coupled to the power source. The outlet member 42 is designed for being selectively operationally coupled to at least one power tool whereby the outlet member 42 is for supplying power to the power tool.

A chord member 44 is operationally coupled to the switch member 40 and the outlet member 42. The chord member 44 is designed for being selectively operationally coupled to the power supply whereby the chord member 44 is for transferring power from the power supply to the switch member 40 and the outlet member 42 when the chord member 44 is operationally coupled to the power source.

A conduit member 46 is coupled to one of the leg members 20 of the ladder assembly 12. The conduit member 46 is positioned over a portion of the chord member 44 whereby the portion of the chord member 44 is positioned between the conduit member 46 and the associated one of the leg members 20 of the ladder assembly 12. The conduit member 46 is for inhibiting the chord member 44 being pinched between the ladder assembly 12 and an object and damaging the chord member 44.

In use, the user extends the rear legs 26 from the front legs 24 and positions the ladder assembly 12 in an area where the user will be able to reach the work area. The user then operationally couples the chord member 44 to the power supply, such as a building electrical outlet. The switch member 40 can then be actuated to allow power to being supplied to the light emitting member 34 to illuminate the work area. The socket member 32 can then be adjusted with respect to the stanchion members 38 to allow the user to control what portion of the work area is being illuminated. Should a power tool be required, such as a power drill, the user can plug the power tool into the outlet member 42 to supply power to the power tool.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. The utility ladder for providing illumination to a work area being worked on by a user, the utility ladder comprising:

a ladder assembly for being positioned on a support surface to support the user at a desired height above said support surface when the user is standing on said ladder assembly, said ladder assembly comprising a frame assembly and a plurality of step members coupled to said frame assembly, said frame assembly comprising a plurality of leg members and a deck member, said leg members being coupled to said deck member such that said leg members extend outwardly from said deck member at an angle; and a lighting assembly being coupled to said ladder assembly;

a power supply assembly mounted on said ladder assembly for providing a power source, said power supply assembly comprising a switch mounted on said ladder assembly and being operationally coupled to said light fixture assembly to control supply of power to said lighting assembly from a power source, a cord member connected to said switch and being selectively couplable to the power source for transferring power from the power source to said switch member when said cord member is operationally coupled to the power source, and an outlet member mounted on said ladder assembly and being operationally coupled to said cord member for receiving power from the power source through said cord member when said cord member is operationally coupled to the power source; and wherein said lighting assembly comprises at least one light fixture assembly pivotally mounted on said deck member of said ladder assembly such that said at least one light fixture assembly is pivotable with respect to said deck member;

said lighting assembly comprising a pair of light fixture members;

said leg members of said ladder assembly comprising a pair of front legs and a pair of rear legs, said front legs being fixedly coupled to said deck member, said rear legs being pivotally coupled to said deck member such that said rear legs are selectively pivoted towards said front legs to facilitate storage of said ladder assembly, said rear legs being pivoted away from said front legs to be positioned at an angle said front legs to support the user standing on the ladder assembly;

said ladder assembly comprising at least one bracing member, said bracing member extending between one of said front legs and an associated one of said rear legs, said bracing member being for selectively maintaining positioning of said rear legs with respect to said front legs to inhibit said rear legs from inadvertently moving with respect to said front legs and collapsing said ladder assembly when the user is standing on the ladder assembly;

said light fixture assembly comprising a socket member and a light emitting member, said socket member being coupled to said ladder assembly, said socket member being adapted for being operationally coupled to the power source, said light emitting member being operationally coupled to said socket member such that said socket member supplies power to said light emitting member, said light emitting member being adapted for emitting light to illuminate the work area;

said light fixture assembly comprising a shroud member, said shroud member being coupled to said socket member such that said shroud member extends around said light emitting member when said light emitting member is operationally coupled to said socket member, said shroud member being for reflecting light emitted from said light emitting member toward the work area;

said light fixture assembly comprising a stanchion member, said stanchion member being coupled to said ladder assembly such that said stanchion member is positioned between said socket member and said ladder assembly, said socket member being pivotally coupled to said stanchion member such that said socket member is selectively positionable with respect to said stanchion member to allow the user to adjust the portion of the work area being illuminated by said light emitting member;

wherein said power supply assembly further comprises a conduit member being coupled to said ladder assembly, said conduit member being positioned over a portion of said cord member such that the portion of the cord member is positioned between said conduit member and said ladder assembly, said conduit member being for inhibiting said cord member being pinched between said ladder assembly and an object and damaging said cord member.

* * * * *